United States Patent [19]

Castillo et al.

[11] Patent Number: 4,676,877

[45] Date of Patent: Jun. 30, 1987

[54] PROCESS FOR PRODUCTION OF FINE AND ULTRAFINE ZINC POWDERS BY ELECTROLYSIS IN A BASIC MEDIUM

[75] Inventors: Jean-Michel Castillo; Christian Jankowski, both of Autun; Serge Ferlay, Saint-Florentin, all of France

[73] Assignee: Societe de Promotion des Procedes Hydro-Metallurgiques, Auxerre, France

[21] Appl. No.: 800,618

[22] PCT Filed: Mar. 12, 1985

[86] PCT No.: PCT/FR85/00051

§ 371 Date: Nov. 6, 1985

§ 102(e) Date: Nov. 6, 1985

[87] PCT Pub. No.: WO85/04195

PCT Pub. Date: Sep. 26, 1985

[51] Int. Cl.[4] ..... C25D 1/00

[52] U.S. Cl. ..... 204/10; 204/290 F

[58] Field of Search ..... 204/10, 115, 290 R

[56] References Cited

U.S. PATENT DOCUMENTS

| | | | |
|---|---|---|---|
| 1,397,008 | 11/1921 | McGall | 204/10 |
| 1,846,697 | 2/1932 | Stout et al. | 204/10 |
| 2,285,762 | 6/1942 | Tuwiner et al. | 204/10 |
| 3,208,920 | 9/1965 | Crew . | |
| 3,326,783 | 6/1967 | Winter | 204/10 |
| 3,397,125 | 8/1968 | Tapley | 204/10 |

FOREIGN PATENT DOCUMENTS

| | | | |
|---|---|---|---|
| 56-18358 | 2/1981 | Japan . | |
| 57-192283 | 11/1982 | Japan . | |
| 989475 | 4/1965 | United Kingdom | 204/10 |

OTHER PUBLICATIONS

"Advances in Electrochemistry" Electrochemical Engineering, vol. 2, Dec. 1962, pp. 53–65 article entitled Formation of Powdered Metal Deposits.

Chemical Abstract No. 84:142603g, Electrochemistry, vol. 84, 1976, p. 491.

Chemical Abstract No. 98:151794M, Electrochemistry, vol. 98, 1983, p. 523.

*Primary Examiner*—Howard S. Williams

*Attorney, Agent, or Firm*—Sandler & Greenblum

[57] ABSTRACT

The present invention relates to a process for the production of fine and ultrafine powders of zinc by electrolyzing using a basic medium. A cathode coated with a film of varnish or silicon obtained from an aerosol is used. The electrolyte bath may be stirred during electrolysis by radiating it with ultrasonics. These ultrasounds have an emission frequency on the order of 40 kHz. The initial concentration of the zinc in the bath is preferably limited to about 30 g/l.

6 Claims, 3 Drawing Figures

PROCESS FOR PRODUCTION OF FINE AND ULTRAFINE ZINC POWDERS BY ELECTROLYSIS IN A BASIC MEDIUM

BACKGROUND OF THE INVENTION

1. Field of the Invention

The present invention relates to a process for production of fine and ultrafine zinc powders by electrolysis in a basic medium.

2. Technological Background

The electrolysis of zinc in a caustic medium has been studied for several decades, but its industrial applications have been rare.

Such electrolysis presents some non-negligible advantages:

1. overvoltage of the hydrogen in caustic medium less than in acid medium;
2. production of a very fragile deposit of zinc, eliminating the high costs of scraping of the electrodes necessary in acid medium; and
3. fewer problems of corrosion than in acid medium, allowing lower investment.

The deposit of zinc which is obtained in alkaline medium is slightly coherent, very slightly adherent and furnishes zinc powders hence, for the usual of zinc, the necessity of fusion and of ingoting of the powders is created. In this spirit, the production of zinc in fine particles may be considered as a drawback because high radioactivity leads to an easier oxidation and therefore to a lower yield of fusion (85.90% against 97.99% by the conventional processes).

This phenomenon probably explains the little success of electrolysis in caustic medium.

However, the existence of a large market of zinc powders and dust in the chemistry of catalysts, fillers in general and more particularly for the anti-corrosion paints industry, has guided the study of this type of electrolysis during recent decades.

The zinc powders presently marketed are obtained by thermal process, by fusion and vaporization in vacuo of ingots of zinc. They furnish a fairly wide range of production, from coarse zinc powder to fine and ultra-fine zinc powders.

The powders and dusts obtained by thermal process have the following characteristics:

appearance: matt blue-grey powder
density: 6.9 to 7.1 g/cm$^3$
apparent density: 2 to 2.5 g/cm$^3$
specific surface area: 1100 to 3300 cm$^2$/g.
shape: spherical for the dust, shredded and irregular for the powders $d_{90}$=6 to 17.5μ
$d_{50}$=5 to 20μ depending on the varieties
oversize at 50μ less than 1%
chemical composition:
total Zn: 98.5%
metal Zn: 92 to 96%
Pb=0.15%.

On the other hand, the powders obtained by alkaline electrolysis have the following characteristics:

appearance: blue-grey powder with metal lustre
density: 6.9 to 7.1 g/cm$^3$
apparent density: 0.9 to 1.5 g/cm$^3$
specific surface area: 3000 to 4500 cm$^2$/g
shape: dendritic or needle-shaped
$d_{90}$=160 to 325μ
$d_{50}$=60 to 90μ
oversize at 50μ:60 to 70% chemical composition:
total Zn: 99 to 99.7%-type Z 4–9
metal Zn: 90 to 97%
Pb: 0.005%.

The essential differences therefore reside in the higher specific surface area for the alkaline powders, their much coarser granulometry and their very different shapes, namely:

spherical for the powders by thermal process; and
planar for the powders obtained by alkaline electrolysis.

Thus, the powders obtained by alkaline electrolysis must be ground in order to approach the granulometric standards of the powders obtained by thermal process. However, grinding does not make it possible to obtain powders having a d50=20μ (compared to d50=7.5μ on average for the powders obtained by thermal process).

Hence the research has been conducted, intended to reduce the d50 of the powders obtained by electrolysis in alkaline medium.

The tests were carried out on the basis of the following parameters:

voltage at the terminals of the cell: U=2.8 to 3.5 V
current density: J=750 to 900 A/m$^2$
distance anode/cathode: d=2.0 to 3.8 cm
concentration of caustic soda: $C_{NaOH}$=240 g/l
concentration of zinc: $C_{Zn}$=5 to 45 g/l
temperature: ambient—19° to 22° C.

Electroplating obeys two processes:

1. nucleation: formation of blanks of crystals; and
2. growth of the crystal.

The size of the grains obtained depends essentially on the ratio of the speeds of these two processes. If the speed of nucleation is higher than the speed of growth of the crystal, the deposit will be fine, and vice versa. The crystals will grow quickly and will therefore be coarse if the metal ions arriving at the solid-liquid interface are numerous. On the other hand, the centers of nucleation will be abundant and the crystals will grow slowly and will therefore be fine, if the metal ions arriving at the solid-liquid interface are rare.

Hence, in essence, the concentration of the metal ions near the interface, therefore in the NERNST layer, will determine the granulometry of the deposit. On these theoretical bases, the earlier studies have concerned the monitoring of the process of diffusion and therefore the following parameters:

1. current density
2. concentration of the electrolyte
3. temperature
4. stirring of the bath
5. presence of colloids
6. presence of metallic complexes.

All these techniques are interested in the electrolyte and in the faradic current, but none studies the electrode.

Now, electrolysis causes relationship to intervene between the current, the electrolyte and the electrodes. In the studies on alkaline electrolysis, the study of the cathode has always been seen from the standpoint of corrosion and it has been directed to the search for a corrosion-resistant material.

The essential conclusions of this study are that all the materials more electropositive than zinc and not soluble in caustic solutions may be used to constitute the cathode. In this way, the metals used were stainless steel, magnesium or alloys rich in magnesium (electron metal) and incidentally zinc.

At the beginning of alkaline electrolysis, a very fine film of zinc covers the surface of the cathode; subsequently the zinc is deposited in the form of needles or dendrites.

The mechanical strength and appearance of this film is variable depending on the metal constituting the cathode and depending on the surface appearance of this cathode.

On all the metals, apart from magnesium, this film is very adherent and the recovery of the zinc, by a light scraping, respects it. However, on certain cathodes, blisters and blisterings appear, corresponding to the detachment of this sub-layer. This phenomenon is highly detrimental to the granulometry, as it produces plates of size varying from one millimeter to one centrimeter. Detailed observation shows that, in these zones, very fine irregularities of the surface of the cathode are visible—striae, pitting, . . . —probably prior to the use of the metal as electrode.

After numerous trials directed to the influence of the surface state of the cathode on the granulometry of the zinc powder obtained, it has been discovered, according to the invention, that it was possible to obtain a fine or ultra-fine powder because of a special treatment of the cathode used for electrolysis.

SUMMARY OF THE INVENTION

To this end, according to the invention, this process of production of fine and ultra-fine zinc powders by electrolysis in a basic medium is characterized in that a cathode coated with a film of varnish or of silicon obtained from an aerosol is used.

According to a complimentary feature of the invention, the bath may be stirred, during electrolysis, by irradiating it by means of ultra-sounds, preferably having a frequency of emission of 40 kHz.

According to a complimentary feature of the invention, the initial concentration of zinc of the bath is preferably limited to about 30 g/l.

The process according to the invention makes it possible to obtain, by alkaline electrolysis, fine and ultra-fine powders, and this directly, without requiring a complementary grinding.

Various forms of embodiment of the present invention will be described hereinafter by way of non-limiting examples, with reference to the accompanying drawings, in which:

DETAILED DESCRIPTION OF THE PREFERRED EMBODIMENTS

Figure 1:
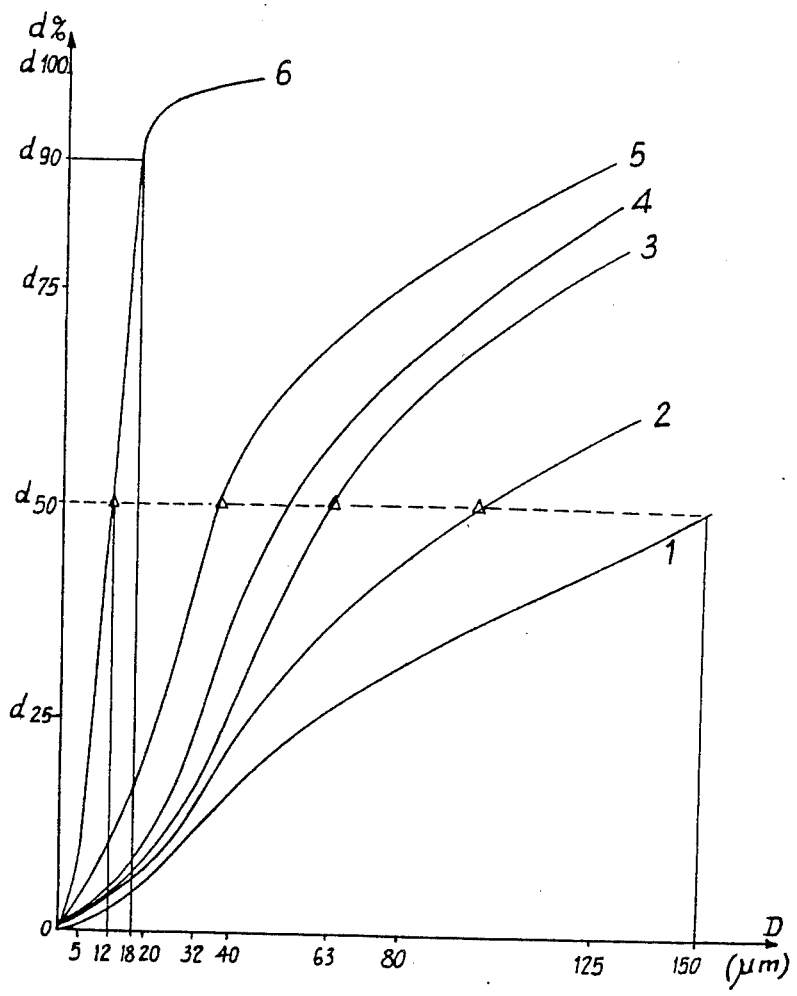
FIG. 1 is a diagram illustrating the influence of the surface state of the cathode on the granulometry of the zinc powder obtained.

In order to study the influence of the state of the cathode on the granulometry of the zinc powder obtained, trials of electrolysis were proceeded with five different types of electrodes, namely:

1. an electrode in zinc corroded by caustic soda;
2. an electrode in zinc, non-corroded but having undergone numerous scrapings during the recovery of the zinc foam;
3. an electrode in stainless steel, new and non-corroded, but striated with abrasive in two perpendicular directions;
4. an electrode in stainless steel, new; without particular preparation.
5. an electrode in stainless steel polished with very fine abrasive.

The use of these electrodes under identical conditions of current density, of concentration of electrolyte and of temperature, leads to an immediate remark, namely that a considerable variation of the granulometry of the zinc powders is obtained from one trial to the next. The results of these trials are seen from curves 1 to 5 of FIG. 1 corresponding respectively to the use of the five electrodes mentioned above. In this FIG. 1, the granulometry D in microns (mesh) of the zinc powder obtained is indicated on the x-axis and the accumulated undersize d in % is indicated on the y-axis.

It is easy to see that the d50 varies from 150 to 37 microns for trials 1 to 5.

Furthermore, the following should be noted:

1. a very poor adhesion and large thickness of the sub-layer for trial 1;
2. a very strong adhesion and a large thickness of the sub-layer for trial 3;
3. a normal adhesion and blisterings of the sub-layer for trial 2;
4. a weak adhesion and the existence of blisterings of the sub-layer for trial 5.

The first conclusion of these trials leads to ascertaining that the surface state has considerable importance on the granulometry and on the formation of the sub-layer but that polishing, even a fine one, does not totally eliminate the separations of the zinc film.

The irregularities, even very fine, of the surface of the electrode have a noteworthy influence on the formation of the sub-layer.

A very fine polish becoming necessary, the use of an electrode coated with a film of varnish or of silicon by aerosol was tested according to the invention.

The results obtained are spectacular and they are illustrated by the curve 6 of FIG. 1:

1. very uniform, very fine and very adherent sub-layer;
2. $d50=12\mu$; $d90=18\mu$ The use of varnish or of silicon deposited by aerosol on the electrode requires some precautions.

In the first place, the varnish or the silicon used must present a chemical resistance to the attack of the caustic solutions.

Furthermore, the deposit of varnish or silicon must be as regular as possible, this assuming an appropriate dosage of solvent. In fact, a varnish which is too viscous forms, during projection thereof, granules which solidify without spreading and consequently recreate, on attenuating it, a surface heterogeneity. Similarly, varnishing with a brush leads to mediocre results. It therefore appears essential that the solvent be sufficiently dosed to allow spreading by flow by gravity of the varnish or of the silicon. This condition being fulfilled, the surface may be considered as very regular.

An excess of diluent is not advantageous either, the low viscosity then leading to a flow along the electrode before drying and to a poor distribution of the varnish.

The phenomena of blisterings and of blisters then reappear.

It is obvious that the cathodes thus treated must be exempt of dust and traces of fat, or of any other element, preventing a close bond between metal and varnish.

The process according to the invention may possibly be improved by acting on the control of other parameters, namely the concentration of zinc in the electrolysis and the stirring of the bath.

Figure 2:
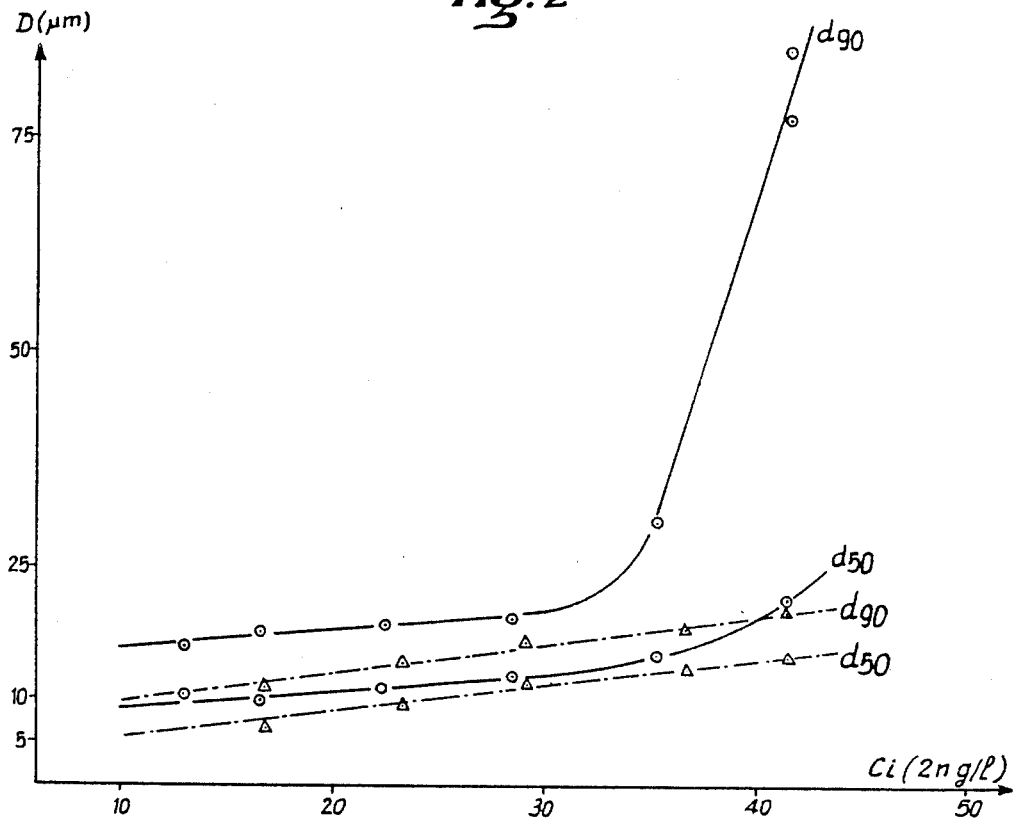
FIG. 2 is a diagram illustrating the influence of the initial concentration of zinc on the granulometry of the zinc powder obtained, both in the case of stirring of the bath by means of ultra-sounds and without such stirring.

With constant current density, temperature and stirring of the bath, the solid line curves of FIG. 2 show the influence of the initial concentration of zinc Ci (between 10 and 45 g/l), indicated on the x-axis, on the d50 and d90 of the powder obtained, in the absence of any stirring of the bath, the granulometry D in microns of the powder being plotted on the y-axis.

These two curves demonstrate the existence of a sudden change of behaviour (phenomenon of threshold) between 30 and 33 g/l for d90=f(Ci) and between 35 and 40 g/l for d50=f(Ci). This phenomenon is to be connected with the speed of nucleation/speed of crystalline growth ratio.

In the weakly decreasing part of the curves, electrolysis is controlled by the diffusion of the metallic ions in the NERNST layer and the speed of nucleation is greater than the speed of growth of the crystals, and vice versa in the strongly decreasing part.

It should be noted that the influence of the initial concentration of zinc, that is, Ci is greater on d90 than on d50 beyond 30 g/l. On this side, the two curves are parallel and this corresponds to a reduction in the size of all the grains formed (translation of the granulometric curve). This translation is of low amplitude. In this way, the industrial monitoring of the granulometry is facilitated. From the foregoing, it is therefore seen that a considerable variation of the concentration of zinc ci of the electrolyte provokes a slight variation of d50 provided that Ci remains less than 30 g/l. Only the upper limit of Ci is to be regulated industrially.

Stirring of the electrolyte allows a homogenization of the concentrations in the bath; this stirring exists naturally by thermal convection and sedimentation by gravity.

The methods usually employed reside in the injection under pressure of the electrolyte at well chosen spots or in a mechanical stirring.

These methods prove to have little efficacy. In fact, the double layer near the electrode is very little affected by this stirring, hence the search for an efficient method of stirring, influencing the double layer.

One possibility is offered by the creation, within the liquid, of cavitations of high intensity by ultra-sound radiation.

The search for an efficient cavitation in a fairly viscous medium such as caustic soda at ambient temperature leads to selecting a frequency of emission of 40 kHz. Thus, tests have been run with constant current density, constant temperature, initial concentration of zinc variable from 10 to 42 g/l and radiation with ultrasounds at 40 KHz and an effective power of about 10 W/l.

The results are given by the curves in chain-dotted lines in FIG. 2 and they call for three comments:

1.
   reduction of the d50 from 6 to 2μ with respect to the trials without radiation with ultra-sounds;
   reduction of the d90 from 12 to 5μ with respect to the trials without radiation with ultra-sounds.

2.
   clear tightening of the granulometric zone:
   d90−d50=5μ
   d90−d10=10 to 12μ

3. the phenomenon of threshold observed without radiation with ultra-sounds disappears.

The influence of the ultra-sounds on the fineness of the grain during an electrolysis is a phenomenon corresponding to several effects:

1. reduction of the thickness of the double layer;
2. facilitated desorption of the gases formed at the electrode;
3. creation of centers of nucleation;
4. mechanical rupture of the large crystals.

The reduction of the thickness of the double layer appears doubtful as d50 and d90=f(Ci) show that the electrolysis is always controlled by the diffusion.

Varnishing of the electrode, according to the invention, obviously introduces a loss of faradic yield by addition of a supplementary ohmic resistance to the cell. This loss is in fact very small (1 to 2%) of the order of the total uncertainty of the measurements, and it is obvious that the efficiency brought to the granulometric control is without common measure with this decrease in yield. Furthermore, the very regular character of the deposit (no "warts" or spots creating short-circuits) which varnishing induces, makes it possible to reduce the anode/cathode distance and to broadly compensate this resistance.

The faradic yield depends:

1. on the electrolysis of the solvent: release of hydrogen at the cathode;
2. on the electrolysis of the impurities of the solution: for example chlorine;
3. on the corrosion by the electrolyte of the electroplated zinc—very weak if the solution is correctly purified and therefore if the zinc is pure.

Thus, with the following means parameters:
concentration of sodium hydroxide=240 g/l
concentration of chloride=5 g/l to 10 g/l
concentration of zinc >10 g/l
electrodes non-corroded and non-siliconed the mean faradic yield is 82% and hardly variable.

Figure 3:
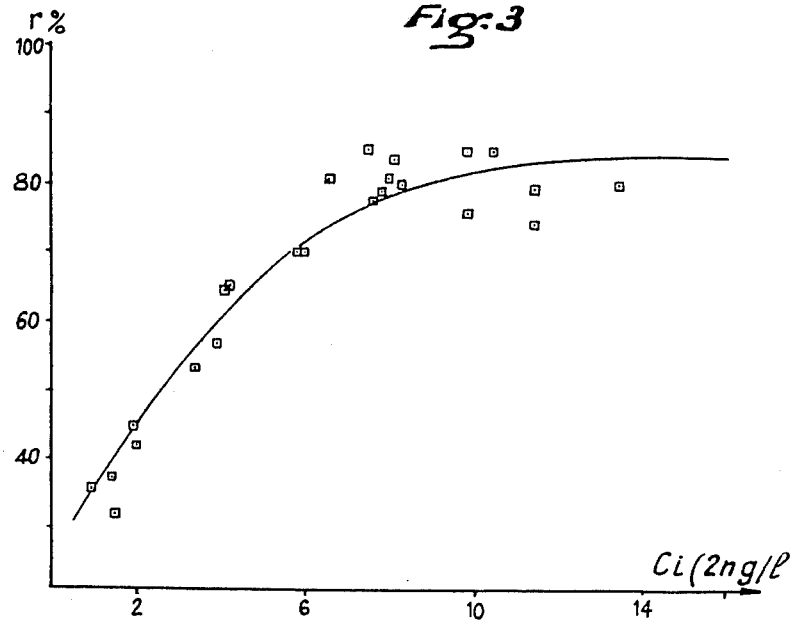
FIG. 3 is a diagram illustrating the influence of the initial concentration of zinc on the faradic yield.

If the concentration of zinc Ci of the electrolyte is less than 10 g/l, then the faradic yield decreases to reach 30% at 0.5 g/l as indicated by the curve of FIG. 3.

Under the same conditions with varnished cathodes, the mean faradic yield is 83%.

It should be noted that the total polarization of the cell increases, in connection with the increase of the chemical resistance (with equal anode-cathode distance).

With radiation by ultra-sounds, the polarization of the cell decreases. This result was expected and perhaps to be connected with the reduction of the thickness of the double NERNST layer. Under these conditions—siliconed cathode and radiation by ultra-sounds—the mean faradic yield is 88%.

From the foregoing description, it may be seen that the combined actions on the surface state of the cathode by varnishing or deposit of silicon, the radiation by ultra-sounds and the concentration of the incoming electrolyte terminate in the production of ultra-fine zinc powder never obtained by conventional alkaline electrolysis, the modification of the solid-liquid interface of the cathode being the primordial parameter of the process according to the invention.

We claim:

1. A process of forming fine and ultra-fine zinc powders comprising the step of energizing an electrode having a surface coated with a film selected from the group consisting of varnish or silicon which is deposited by an aerosol in a basic medium bath to electroplate the zinc powders onto said electrode.

2. The process according to claim 1 wherein said electrode is a cathode.

3. The process according to claim 1 further comprising the step of radiating said basic medium bath with ultrasounds to stir said bath during said process.

4. The process according to claim 3 wherein said step of radiating comprises agitating a double layer adjacent to said electrode by said ultrasounds for reducing said double layer.

5. The process according to claim 3 wherein said step of radiating comprises the step of radiating said bath with ultrasounds having an emission frequency on the order of 40 kHz.

6. The process according to claim 3 further comprising the step of forming said basic medium bath having an initial concentration of zinc of about 30 g/l.

* * * * *